United States Patent [19]

Zehnder et al.

[11] Patent Number: 4,875,836

[45] Date of Patent: Oct. 24, 1989

[54] SELF-SUCKING PUMP APPARATUS FOR LIQUIDS

[75] Inventors: Paul Zehnder, Birmenstorf, Switzerland; Hans-Ulrich Niklaus, Windisch, Switzerland; Engelbert Schmiedl, Rohrdorf, Switzerland; Franz Patri, Frankfurt am Main, Fed. Rep. of Germany

[73] Assignee: K. Rütschi AG, Brugg, Switzerland

[21] Appl. No.: 141,807

[22] Filed: Jan. 11, 1988

[30] Foreign Application Priority Data

Jan. 15, 1987 [CH] Switzerland ..... 132/87

[51] Int. Cl.[4] ..... F04B 17/00

[52] U.S. Cl. ..... 417/360; 417/423.3; 417/423.15; 417/424.1; 376/461

[58] Field of Search ..... 417/360, 361, 363, 423 B, 417/423 L, 423 T, 424 R, 410, 902; 376/402, 404, 405, 378, 461

[56] References Cited

U.S. PATENT DOCUMENTS

| | | | |
|---|---|---|---|
| 2,832,292 | 4/1958 | Edwards | 417/360 |
| 2,890,009 | 6/1959 | Chapellier | 376/461 |
| 2,934,245 | 4/1960 | Emeny | 415/182 |
| 3,737,255 | 6/1973 | Emeny | 417/424 R |

FOREIGN PATENT DOCUMENTS

| | | | |
|---|---|---|---|
| 177091 | 10/1961 | Sweden | 417/360 |

*Primary Examiner*—Leonard E. Smith
*Assistant Examiner*—Robert N. Blackmon
*Attorney, Agent, or Firm*—Werner W. Kleeman

[57] ABSTRACT

The pump apparatus comprises a pump, suction device and a pressure container. The suction device is constructed as a structural unit and can be inserted coaxially from above into the pressure container. The pump likewise is constructed as a structural unit which can be inserted from above with self-centering and self-sealing connections coaxially into a hollow compartment of the suction device and is connectable therewith. By means of threaded bolts which, upon lowering the suction device, piercingly extend through bores provided at a ring flange of the suction device, the inserted suction device can be connected with the pressure container. If the need exists this can be accomplished by remotely controlled manipulator expedients. In analogous fashion threaded bolts protruding from the upper end of the suction device, during installation of the pump, extend through bores of the pump housing, so that the pump also can be fixed in its mounted position by remotely controlled manipulator expedients and can be released from such mounted position. The assembly and disassembly of the pump apparatus for repair and maintenance purposes can thus be accomplished rapidly and simply also with the aid of remotely controlled manipulator expedients. Any fluid leakage which arises during disassembly of the pump apparatus or because of a defect always remains in the pressure container.

5 Claims, 3 Drawing Sheets

SELF-SUCKING PUMP APPARATUS FOR LIQUIDS

BACKGROUND OF THE INVENTION

The present invention relates to a new and improved construction of a self-sucking pump apparatus for liquids, which pump apparatus is of the type comprising, a pump, a suction device and a closable pressure container or vessel.

In process technological chemical plants or installations as well as in plants or installations exploiting nuclear engineering or technology there are employed pump apparatuses. For reasons of safety or for reasons of protecting the operating personnel or workers these pump apparatuses are only partially accessible or, in fact, not at all directly accessible. Moreover, for reasons of protecting the environment, but also because of the need to protect the conveyed liquids against external influences, extremely high requirements are placed upon these pump apparatuses as concerns operational reliability and the avoidance of leakage of the pumped liquids or fluid media.

Pump apparatuses are required particularly in process technological installations in hot cells of installations working with nuclear technology, for instance, for chemical, mechanical and thermal processes and fuel preparation. Such pump apparatuses ar also utilized in process technological installations or plants which operate with high grade or highly sensitive liquids or with dangerous, especially toxic, radioactive, explosive or easily combustible liquids. The maintenance and servicing of such pump apparatuses inclusive of the assembly and disassembly thereof during repair work, without endangering the operating personnel or workers, is possible, also through the use of remotely controlled manipulator expedients or robots. Such pump apparatuses, for the aforementioned purposes, also must be capable of being rapidly and simply disassembled or dismantled and in order to accomplish the maintenance and repair work or other work which is to be carried out must be capable of being removed out of the danger zone. During such manipulation of the pump apparatuses there must be avoided the uncontrolled loss of the conveyed liquid and this is something which cannot be tolerated in such installations.

The handling in conjunction with the maintenance or servicing of the pump apparatuses which are employed within hot cells of nuclear technology is of particular importance. Upon malfunction of a pump device it is necessary under certain circumstances to shut down the entire installation or plant and then there must be accomplished numerous and complicated decontamination operations. In those situations in which the environment or surroundings of the pump apparatus cannot be contaminated to such a degree that there is no danger of radioactive contamination of the operating personnel or workers which are employed for undertaking the repair or servicing work, such repair and servicing operations are associated with an extremely great amount of work, material costs and time, apart from the economic consequences resulting from longer standstill or downtimes of the plant or installation.

Furthermore, it is to be considered that with the heretofore known pump apparatuses which were employed in such fields of application and of the previously mentioned type, the pump, the associated suction device with suction lines, pressure lines and the ejectors for the initiation of the liquid conveyance, and also the pressure container, were each arranged adjacent one another upon a base plate. This, in turn, required undertaking particular safety measures, for instance to prevent liquid leakage or loss at the mountings of fittings, flanges, pipelines and the like.

SUMMARY OF THE INVENTION

Therefore with tee foregoing in mind it is a primary object of the present invention to provide a new and improved construction of a pump apparatus for liquids which does not suffer from the aforementioned drawbacks and shortcomings of the prior art constructions.

Another and more specific object of the present invention aims at the provision of a new and improved construction of a pump apparatus of the previously mentioned type, particularly a pump apparatus for pumping liquids and comprising a pump, a suction device, and a closable pressure container, which, firstly, in a most simple manner can be disassembled and again assembled, also through the use of remotely controlled manipulator devices or expedients or the like, especially for accomplishing repair and maintenance work in a most rapid and positive fashion, and wherein, secondly, there can be extensively avoided the danger that through the presence of defective mountings or fittings, flanges and the like, escaping conveyed liquid can contaminate neighboring parts or components of the installation or can be contaminated thereby.

Now in order to implement these and still further objects of the invention, which will become more readily apparent as the description proceeds, the self-sucking pump apparatus for liquids of the present development is manifested by the features that, the suction device is constructed as a structural unit or component which can be inserted coaxially from above into the pressure container and connected therewith. Equally, the pump is also constructed as a structural unit or component which can be coaxially inserted from above with self-centering connections into a hollow space or compartment of the suction device and connected therewith. Moreover, these structural units can be selectively connected with one another or released from one another by the use of remotely controlled manipulators or manipulator devices.

First of all, in order to fulfill the stated object of preventing contamination of parts or components by the escape of the conveyed or pumped liquid, the invention contemplates that the pump and suction device together with all of the connections and so forth are accommodated within the pressure container or vessel. There extends into and out of the upper closure or closure member of the pressure container or vessel only the lines or conduits leading to the pump and away from the pump. Any possible arising leakage of the conveyed liquid at the connections of the suction studs or connections, pressure studs or connections, the lines or conduits of the suction device and so forth, remain in the closed pressure container. In this way there is integrated a first barrier in the pump apparatus for the retention of any escaping liquid. Also the pump itself is closed at all sides by the pressure container or vessel and thus does not require any special containment structure. This is of particular significance in terms of the barrier safety concept which is employed in nuclear engineering or technology.

As far as the solution of the part of the stated object concerning the rapid and positive dismantling and reassembly or remounting of the pump apparatus, such is fulfilled in that after releasing the connection elements which interconnect the individual parts or components, such connection elements preferably being constituted by threaded connections or clamp closures which can be readily operated upon by remotely controlled manipulators or manipulator devices, for instance impact wrenches or spanners or screw drivers or the like, the pump apparatus can be disassembled or dismantled, for instance through the further use of remotely controlled manipulators or manipulator devices, for instance, appropriate lifting tools or devices. For the disassembly work, initially the pump and thereafter the pressure device are upwardly withdrawn out of the suction container. The reassembly or remounting work also is accomplished in an equally simple fashion with the reverse sequence of operations. As a result there is realized in this manner the important advantage that the most sensitive components, namely the pump, can be initially dismantled and again remounted as the last structural unit or component, so that in the event of a defect or for the service or maintenance of the pump it is only necessary to dismantle that structural unit or component and thereafter to again remount the same. During the lifting-out of the pump and/or during the disconnection of the connection elements any escaping conveyed liquid remains in the pressure container.

A particularly advantageous construction of the suction device contemplates providing such suction device with a closure flange or flange member having a central opening coordinated or matched to the external diameter of the pump. When the pressure device is mounted at the suction container the closure flange or flange member bears upon the upper edge of the pressure container and is releasably or detachably connected therewith by means of suitable connection elements, such as threaded bolts and coacting nuts.

By virtue of the aforedescribed advantageous design of the suction device there is also possible an equally advantageous construction of the pump. In this regard the pump contains a peripheral flange which, when the pump is inserted into the pressure device, bears upon an inner edge or region of the closure flange of the suction device and thus in conjunction with this closure flange upwardly closes off or seals the pressure container. The peripheral flange of the pump is releasably connected by means of suitable connection elements, such as threaded bolts and nuts, with the closure flange of the suction device.

According to a further advantageous design of the pump apparatus of the present development at the upper end of the pump and at the upper end of the suction device there are provided respective elements at which there can be suspended an engagement member or gripper means of, for instance, a remotely controlled lifting device or tool.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the pump apparatus of the present development and the related structure have been shown in detail therein as are needed to enable those skilled in the art to readily understand the underlying principles and concepts of this invention.

Figure 1:
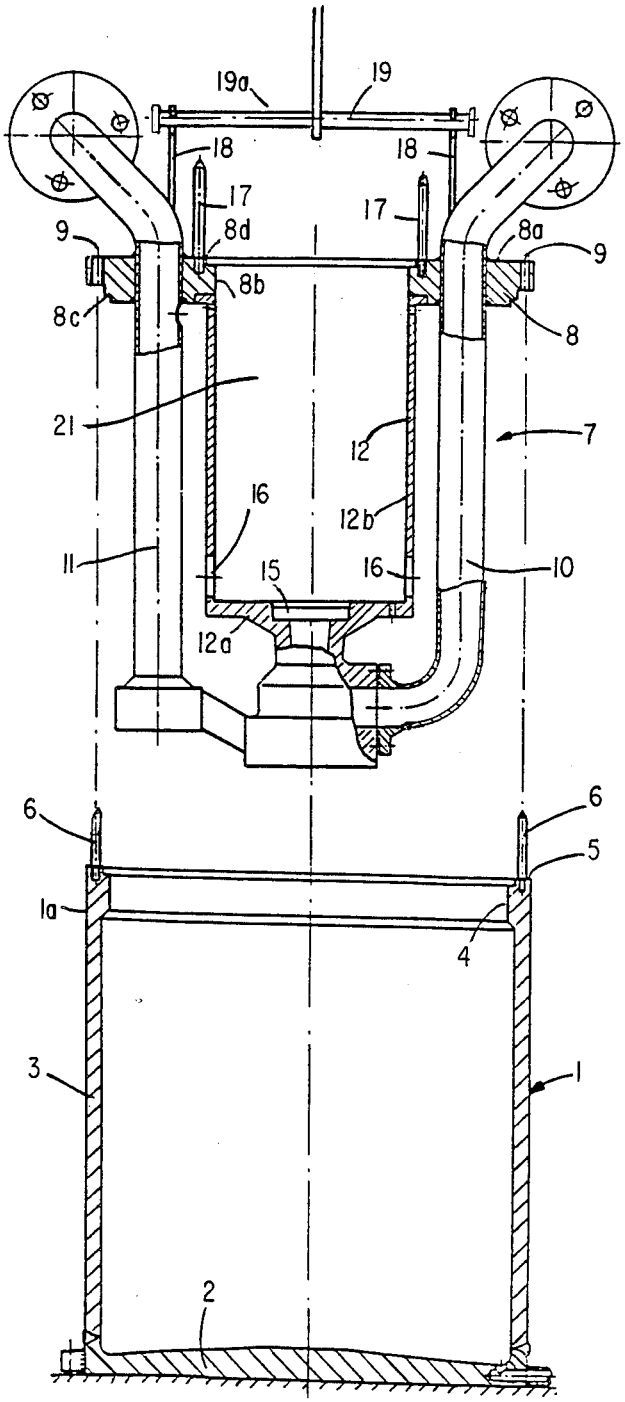
FIG. 1 schematically illustrates partially in sectional view and in exploded representation the suction container or vessel and the suction device which can be inserted from above into the pressure container or vessel and also removed from above out of such pressure container or vessel.

Turning now specifically to FIG. 1 of the drawings, there is depicted therein a pressure container or vessel 1 which is open at its top end or region 1*a* and comprises a base plate 2 and a substantially cylindrical jacket or shell 3 which is appropriately connected with the base plate 2, for instance by being welded thereto. At the upper open end 1*a* of the pressure container or vessel 1 the jacket or shell 3 is provided with a ring-shaped or annular inner shoulder 4 and at its end surface or face 5 this pressure container 1 is provided with a plurality of suitable connection or connecting elements, here shown as a plurality of upwardly protruding threaded bolts 6 which are appropriately distributed about the circumference of the end surface or face 5 of the pressure container 1 and threadably connected thereat.

Continuing, the suction device which is advantageously constructed as a structural unit or component, has been generally designated in its entirety by reference numeral 7. This suction device 7 comprises a closure flange or flange member 8*a* provided with a central opening 8*b*. In the embodiment under discussion the closure flange or flange member 8*a* is constructed as a ring or annular flange or flange member 8, the outer diameter of which essentially corresponds to the outer diameter of the substantially cylindrical jacket or shell 3 of the pressure container 1, and the peripheral portion of this ring or annular flange or flange member 8 is provided with appropriate stepped regions or portions 8*c*. By means of the stepped regions or portions 8*c* of the ring flange 8 there is ensured for the appropriate exact fitting or seating of the ring flange 8 at the ring-shaped or annular inner shoulder 4 of the pressure container 1 and thus the reception of such ring flange 8 at here not further illustrated but conventional sealing rings.

Moreover, it will be understood that the ring flange 8 of the suction device 7 is provided with bores or through-holes 9 which as concerns their number, diameter and spatial position are coordinated to the number, diameter and spatial position of the threaded bolts 6 of the pressure or vessel 1. In this way the suction device 7 can be securely connected with the pressure container or vessel 1, while at the same time there is facilitated the release or disconnection of these components from one another as will be explained more fully hereinafter. The ring flange 8 serves as the carrier and holder for lines or pipes or other appropriate facilities or structure piercingly extending through the ring flange 8 of the suction device 7, such as for instance an infeed line 10 leading to the pump 22 (FIGS. 2 and 3), a pressure line or conduit 11 leading away from the pump 22, as well as for the reception of a substantially cylindrical housing 12 which houses or accommodates the pump 22, as such will also be explained in greater detail hereinafter. This suction device 7 possesses, as is well known, ejectors and throughflow openings 15 and 16 located respectively at the floor 12*a* and side wall 12*b* of the housing 12 for the inlet of the sucked-up liquid to the pump 22 and for the escape or discharge of the conveyed liquid out of this pump 22.

At the inner edge or edge region 8*d* of the ring flange 8 there are threadably connected, analogous to the threaded bolts 6 of the pressure container 1, along the circumference of this inner edge or edge region 8*d* of the ring flange 8 a number of distributively arranged connecting or connection elements, here shown as a plurality of upwardly protruding threaded bolts or bolt members 17. Additionally, at the ring flange or flange member 8 there are secured suitable assembly and disassembly facilities, here shown in the form of hooks or hook members 18 at which the entire structural unit or component constituted by the above-described suction device 7 can be suspended, for instance at grippers or gripper elements 19 of a suitable remotely controlled lifting device or tool, generally designated by reference character 19*a* so that, as shown in FIG. 2, the suction device 7 can be inserted into the pressure container 1.

Upon insertion of the suction device 7 into the pressure container 1 the ring flange 8 bears against the end surface or face 5 of the pressure container 1 and the threaded bolts or bolt members 6 piercingly extend through the bores or throughpass openings or through-holes 9 provided in the ring flange 8. By means of nuts or nut members 20 or equivalent structure, which if desired or required can be manipulated by remotely controlled manipulators or manipulating devices, generally indicated in FIG. 2 by reference character 50, the nut members or nuts 20 can be threaded on to the threaded bolts or bolt members 6. Consequently, the suction device 7 can now be coaxially positively fixed within the confines of the pressure container 1, as the same has been particularly illustrated in FIG. 2.

Figure 2:
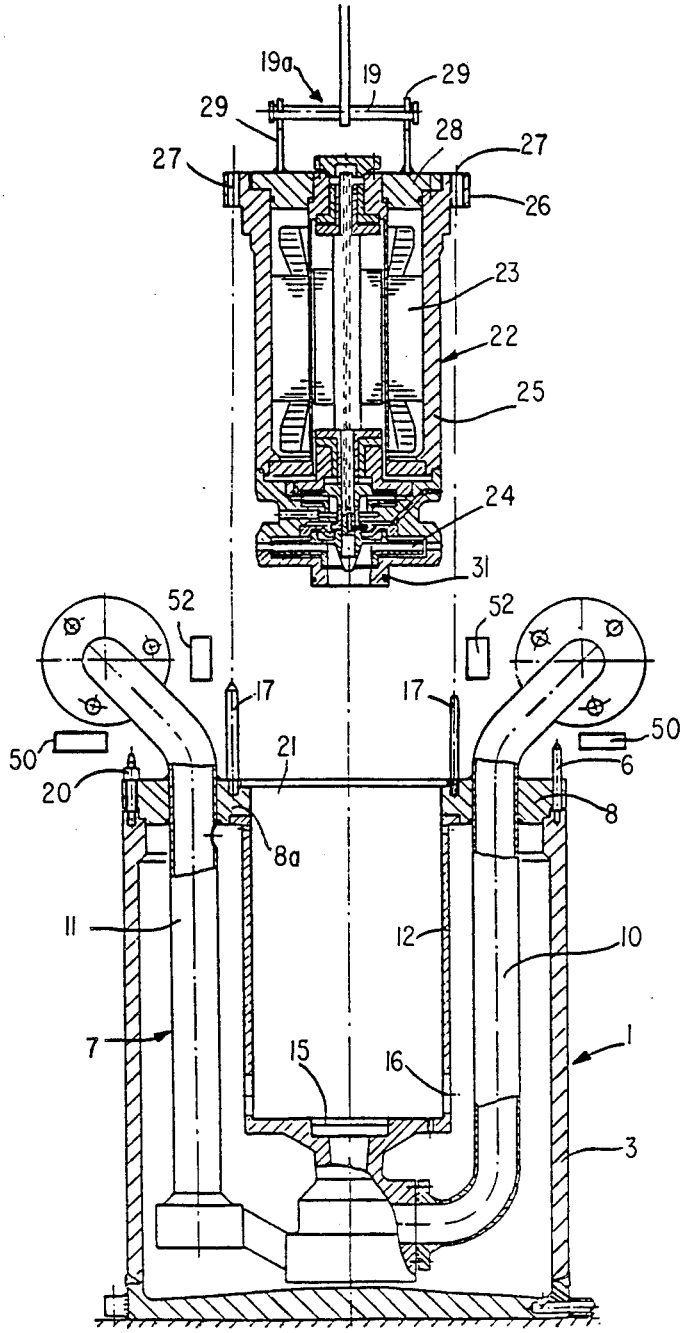
FIG. 2 again illustrates schematically partially in sectional view the suction device after it has been mounted in the pressure container and in exploded representation the pump which can be inserted from above into this assemblage of the pressure container and the therein mounted suction device and can also be removed from above out of this assemblage.

From the illustration of FIG. 2 it will be apparent that the internal space of the housing 12 forms a hollow compartment or chamber 21 which can house or receive the pump 22 of the inventive pump apparatus and which pump is constructed as a structural unit or component. The pump 22 is here depicted as a canned motor pump comprising a motor portion or part 23 and a pump portion or part 24 which are surrounded by a housing 25. At the upper motor-side end of the pump 22 there is formed at the housing 25 a peripheral flange or flange member 26, the circumference of which is provided with bores or throughpass openings or through-hole 27 which as concerns their number, diameter and spatial position are coordinated or matched to the threaded bolts or bolt members 17 of the ring flange 8 of the suction device 7. The motor-side closure of the housing 25 is formed by a releasably connected cover or cover member 28 at which there are secured suitable assembly and disassembly facilities, here shown again in the form of hooks or hook members 29. By means of the hooks or hook members 29 the pump 22 can be suspended at, for instance, the grippers 19 of the previously discussed remotely controlled lifting device or tool 19*a* employed for the manipulation of the suction device 7. As a result, during the assembly of the pump 22 in the hollow chamber or compartment 21 of the already assembled suction device 7 such can be lowered therein and during the disassembly out of this operating position the pump 22 can again be raised out of such hollow chamber or compartment 21.

Figure 3:
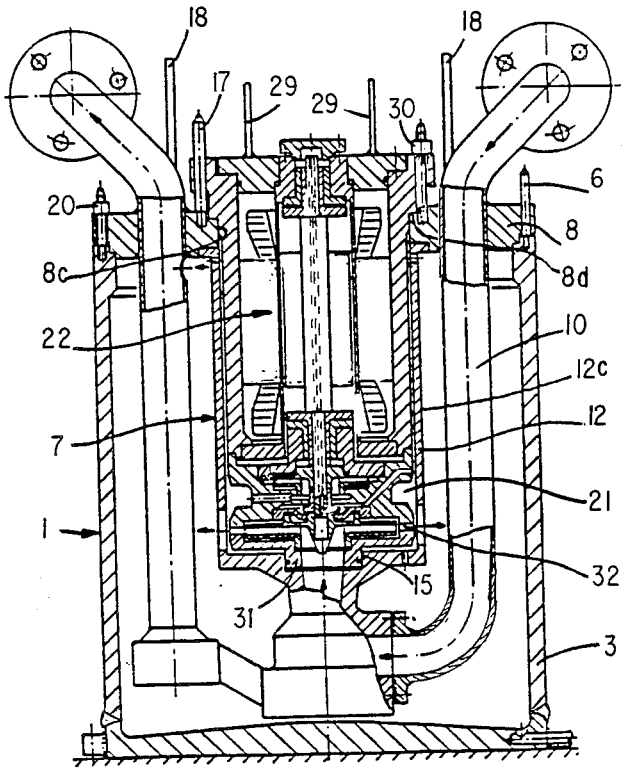
FIG. 3 schematically illustrates again partially in sectional view, the completely assembled self-sucking pump apparatus constructed according to the present invention.

In the assembled state or condition, depicted in FIG. 3, the peripheral flange or flange member 26 of the housing 25 of the pump 22 bears at the inner edge 8*d* of the opening 8*b* of the ring flange 8 of the suction device 7, and the threaded bolts or bolt members 17 of the suction device 7 piercingly extend through the bores 27 of the peripheral flange 26 of the housing 25 of the pump 22. By means of suitable connection or connecting elements, such as the nut members or nuts 30 which are threaded on to the protruding ends of the threaded bolts 17, for instance by the use of conventional remotely-controlled manipulators or manipulator devices 52, for instance impact wrenches or spanners or the like, as schematically depicted in FIG. 2, the mounted pump 22 can be positively fixed in position. At that time, the pressure container 1 is completely closed towards the top or upper end thereof. During the assembly of the pump 22 the suction connection or stud 31 slides in a self-centering and self-sealing fashion into the throughflow opening 15 of the suction device 7 and the pressure outlets or discharge openings 32 of the pump 22 are located opposite to the openings 16 provided at the jacket or shell 12*c* of the housing 12.

Instead of using the canned motor pump as described heretofore with regard to the discussed exemplary embodiment, it is also of course possible for the drive of the pump portion or part 24 to be accomplished by an appropriately sealed dry motor. Additionally, the connection elements, here depicted by way of example and not limitation as threaded bolts 6 and 17 and nut members 20 and 30, equally could be replaced by other suitable connection expedients, such as clamp connectors which can be easily likewise operated by appropriate remotely controlled manipulators or manipulator devices.

The mode of operation of the self-sucking pump apparatus of the heretofore described construction is well known in this technology and therefore need not be here further described, particularly since the details of the operation of the pump apparatus is not necessary for the understanding of the underlying principles and concepts of the present invention.

While there are shown and described present preferred embodiments of the invention, it is to be distinctly understood that the invention is not limited thereto, but may be otherwise variously embodied and practiced within the scope of the following claims. Accordingly,

What we claim is:

1. A self-sucking pump apparatus for liquids, comprising:

a pump containing a motor part;

said pump being constructed as a structural unit incorporating said motor part;

a suction device constructed as a structural unit;

said suction device defining a hollow compartment bounded by a first wall for housing said structural unit inclusive of said motor part of said pump;

self-centering connection means for interconnecting in a self-centering manner said suction device and said structural unit inclusive of said motor part of said pump in the hollow compartment of the suction device;

connecting means for engagement by remotely controlled manipulation means for releasably connecting said structural unit inclusive of said motor part of said pump with said suction device;

said structural unit of said pump containing assembly means for engagement by remotely controlled mounting means for selectively inserting or removing in substantially coaxial manner said structural unit of said pump into and out of said hollow compartment of said suction device;

a closable pressure container bounded by a second wall for receiving said suction device;

connecting means for engagement by remotely controlled manipulator means for releasably connecting said suction device with said closable pressure container;

said suction device containing assembly means for engagement by remotely controlled mounting means for selectively inserting or removing in substantially coaxial manner said suction device into or out of said closable pressure container;

said suction device further containing an infeed line for conducting fluid to be pumped to said pump and a discharge line for conducting pumped fluid away from said pump;

closing means for closing said closable pressure container in the inserted state of said structural unit of said pump and said suction device in said closable pressure container;

said discharge and infeed lines extending through said closing means in a sealed relationship;

said structural unit of said pump, said suction device bounded by said first wall and said closable pressure container bounded by said second wall constituting, when inserted into one another, a self-contained structural unit which is substantially hermetically closed on all sides except for said infeed line and said discharge line and which self-contained structural unit encloses said motor part of said pump.

2. The pump apparatus as defined in claim 1, wherein:

said closable pressure container has an upper edge;

said structural unit of said pump has an outer diameter;

said suction device being provided with a closure flange;

said closure flange having a central opening coordinated to the outer diameter of the pump for receiving therethrough said pump;

said closure flange, when said suction device is inserted into said closable pressure container, bearing upon the upper edge of said closable pressure container; and said connecting means for releasably connecting the suction device with said closable pressure container, releasably connecting said closure flange of said suction device with said upper edge of said closable pressure container.

3. The pump apparatus as defined in claim 2, wherein:

said pump contains a peripheral flange;

said closure flange of the suction device has an inner edge;

said peripheral flange of said pump, when said pump is inserted into said suction device, bearing upon the inner edge of the closure flange of the suction device;

said connecting means for releasably connecting said pump structural unit with said suction device, releasably connecting said peripheral flange of the pump with the closure flange of the suction device;

said peripheral flange of said pump and said closure flange of said suction device conjointly with said upper edge of said closable pressure container constituting said closing means for closing said closable pressure container; and said closing means, in the inserted state of said structural unit of said pump, said pressure device and said closable suction container, contituting barrier means for preventing fluid escape from said self-contained structural unit except through said discharge line.

4. The pump apparatus as defined in claim 2, wherein:

said assembly means are provided at an upper end of said structural unit of said pump and at said closure flange of said suction device for enabling suspension of gripper means of a lifting device constituting said remotely controlled mounting means.

5. The pump apparatus as defined in claim 1, wherein:

said self-centering connection means comprises a suction connection provided at said pump;

said self-centering connection means further comprises a throughflow opening provided at the suction device; and said suction connection of said pump, during insertion of the structural unit of the pump into the suction device, engaging in self-centering and self-sealing fashion into the throughflow opening of the suction device.

* * * * *

UNITED STATES PATENT AND TRADEMARK OFFICE

CERTIFICATE OF CORRECTION

PATENT NO. : 4,875,836

DATED : October 24, 1989

INVENTOR(S) : PAUL ZEHNDER et al

It is certified that error appears in the above-identified patent and that said Letters Patent is hereby corrected as shown below:

Column 3, line 15, after "the" (second occurrence) please delete "pressure" and insert --suction--

Column 3, line 16, after "the" please delete "suction" and insert --pressure--

Column 3, line 34, after "the" (second occurrence) please delete "pressure" and insert --suction--

Column 3, line 36, after "the" please delete "suction" and insert --pressure--

Column 4, line 67, after "pressure" please insert --container--

Column 8, line 33, after "said" please delete "pressure" and insert --suction--

UNITED STATES PATENT AND TRADEMARK OFFICE

CERTIFICATE OF CORRECTION

PATENT NO. : 4,875,836

DATED : October 24, 1989

INVENTOR(S) : PAUL ZEHNDER et al

It is certified that error appears in the above-identified patent and that said Letters Patent is hereby corrected as shown below:

Column 8, line 34, after "closable" please delete "suction" and insert --pressure-- and before "barrier" please delete "contituting" and insert --constituting--

Signed and Sealed this

Nineteenth Day of February, 1991

*Attest:*

HARRY F. MANBECK, JR.

*Attesting Officer*

*Commissioner of Patents and Trademarks*